US006287086B1

(12) United States Patent
Steen

(10) Patent No.: US 6,287,086 B1
(45) Date of Patent: Sep. 11, 2001

(54) HYDRAULIC PUMP WITH BALL JOINT SHAFT SUPPORT

(75) Inventor: Kevin W Steen, Madison, MS (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/511,202

(22) Filed: Feb. 23, 2000

(51) Int. Cl.[7] ..... F04B 1/12
(52) U.S. Cl. ..... 417/269; 91/499
(58) Field of Search ..... 417/269; 91/499; 92/74; 74/60

(56) References Cited

U.S. PATENT DOCUMENTS

| | | | | |
|---|---|---|---|---|
| 3,807,283 | * | 4/1974 | Alderson et al. | 417/269 |
| 4,007,663 | * | 2/1977 | Nagatomo et al. | 91/499 X |
| 4,352,637 | | 10/1982 | Weisenbach . | |
| 4,757,743 | | 7/1988 | Tovey . | |
| 4,771,676 | * | 9/1988 | Matsumoto et al. | 91/499 X |
| 5,011,377 | * | 4/1991 | Sagawa et al. | 417/269 |
| 5,165,321 | * | 11/1992 | Arimoto et al. | 91/499 |
| 5,271,285 | | 12/1993 | Silliman, Jr. et al. . | |
| 5,622,097 | * | 4/1997 | Martensen et al. | 74/60 X |
| 5,681,149 | | 10/1997 | Weatherly . | |
| 5,813,315 | * | 9/1998 | Kristensen et al. | 417/269 X |
| 6,036,374 | * | 3/2000 | Fisher et al. | 91/499 X |

OTHER PUBLICATIONS

Shigley, Joseph Edward; Mechanical Engineering Design; 1977; McGraw–Hill (New York); 3rd Ed.; p. 322.*

* cited by examiner

*Primary Examiner*—Charles G. Freay
*Assistant Examiner*—David J. Torrente
(74) *Attorney, Agent, or Firm*—George E. Haas; Quarles & Brady LLP

(57) ABSTRACT

An in-line axial piston hydraulic pump has a cylinder block with a plurality of bores in which separate pistons slide. The cylinder block is supported on one side by a bearing and axle arrangement. The other side of the cylinder block has an integral shaft with a ball that is received in a spherically concave socket coupled to the housing. The socket provides a drive surface that is non-orthogonal to the rotational axis of the cylinder block and the pistons ride against that surface. The engagement of the pistons with that socket surface produces the sliding movement of the pistons within the bores and thus the pumping action.

18 Claims, 2 Drawing Sheets

HYDRAULIC PUMP WITH BALL JOINT SHAFT SUPPORT

BACKGROUND OF THE INVENTION

The present invention relates to hydraulic pumps, and in particular to in-line axial piston pumps.

Conventional in-line axial piston pumps have a plurality of pistons in multiple bores of a single piece cylinder barrel. The cylinder barrel is keyed to the drive shaft and is rotated by a prime mover, such as an electric motor. The cylinder barrel and the pistons are parallel to the drive shaft. As the cylinder barrel rotates within the pump housing, the pistons follow an inclined surface of a swash plate thereby reciprocating in their bores. The reciprocal motion of the pistons produces a pumping action.

The swash plate typically is a steel ring that is held at an acute angle with respect to the axis of the drive shaft. During one-half of the shaft rotation, each piston is pulled from its bore which draws fluid into that bore. Upon reaching the maximum extended position, the piston starts traveling along a portion of the inclined swash plate which pushes the piston into the bore thereby forcing the fluid to flow out of the pump.

The displacement of a given pump is determined by the number of pistons, each piston's diameter and the length of the stroke. The steeper the angle of the swash plate, the longer the piston's stroke. In a variable displacement pump, the angle of the swash plate can be changed dynamically to alter the stroke and thus the pump displacement.

Pumps of this design are well known and are commonly used in aircraft hydraulic systems. In aircraft applications, the size and weight of the pump are critical. Therefore, any improvement which reduces these factors will have benefit in aircraft usage.

SUMMARY OF THE INVENTION

A hydraulic pump according to the present invention includes a housing that has an inner chamber. A cylinder block with a plurality of piston bores is supported within the inner chamber for rotation about a longitudinal axis. During that rotation each piston bore alternately communicates with a fluid inlet and a fluid outlet in the housing. The cylinder block comprises a spherically curved element and a coupling for a drive member that produces rotation of the cylinder block. A bearing rotationally couples the cylinder block to the housing.

A socket is rotationally coupled to the housing, preferably by another bearing. The socket has an aperture with a surface that mates with the spherically curved element of the cylinder block. A drive surface, provided on the socket, is non-orthogonal to the longitudinal axis. A different one of a plurality of pistons is slidably located within each piston bore and has a head which engages the drive surface of the socket.

The drive member produces rotation of the cylinder block about the longitudinal axis. The socket rotates about an axis that is non-coaxial with the longitudinal axis. Thus as the cylinder block rotates, the pistons reciprocate into and out of the bores providing pumping action. As that rotational movement occurs the socket wobbles across the surface of the partially spherical element of the cylinder block.

DETAILED DESCRIPTION OF THE INVENTION

Figure 1:
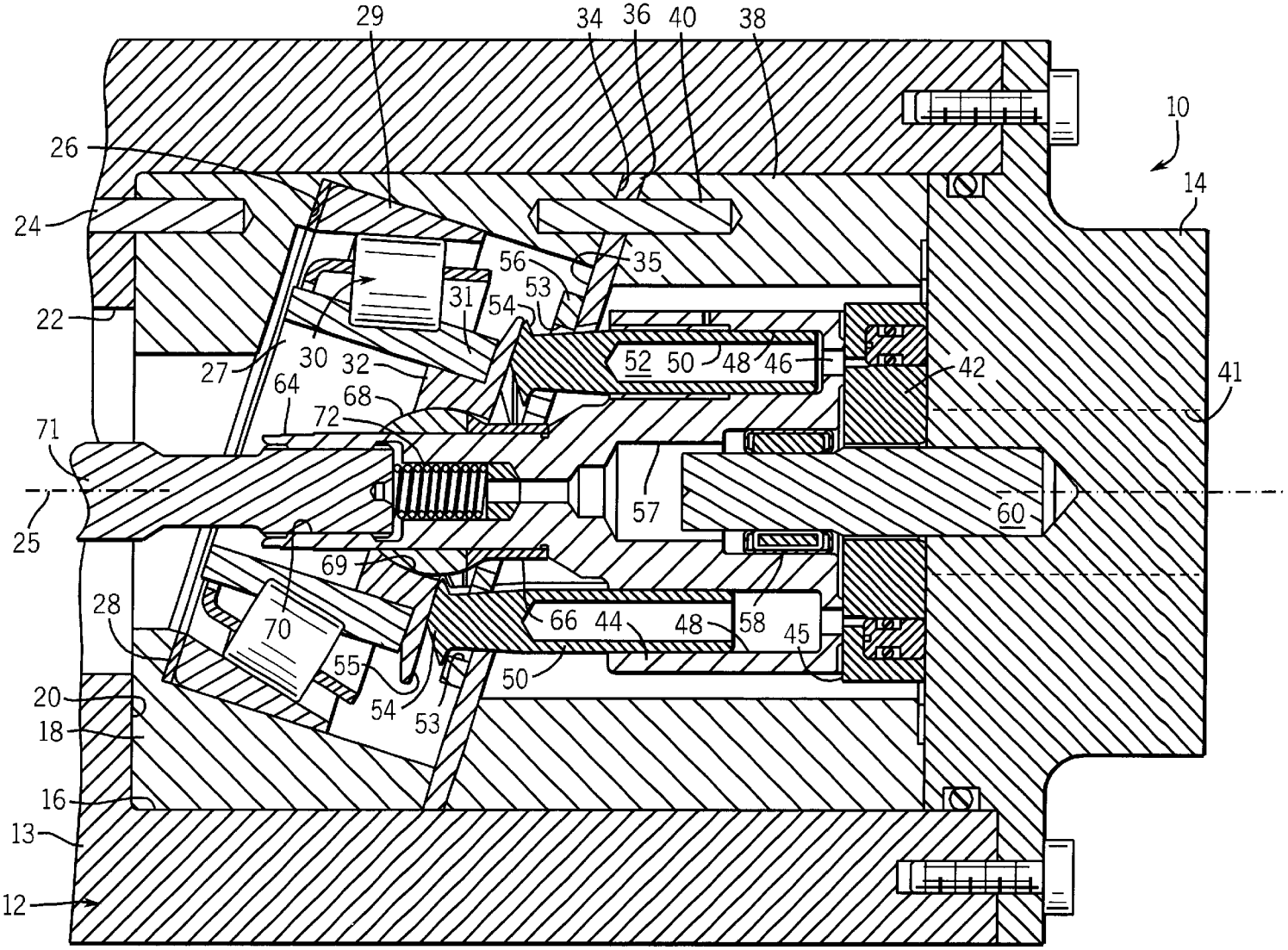
FIG. 1 is a cross-sectional view of a hydraulic pump according to the present invention.

With reference to FIG. 1, a hydraulic pump 10 has a housing 12 formed by a body 13 with an open end that is closed by an end cap 14 held in place by a plurality of machine screws. The body 13 has an inner chamber 16 which contains the components of the pump. An angle block 18 is inserted into the inner chamber 16 resting against an inner wall 20 having a central opening 22. A locking pin 24 extends into holes in both the body 13 and the angle block 18 to prevent the latter component from rotating. The angle block 18 has a bearing cavity 27 with an inner surface 26 which is non-orthogonal with respect to the longitudinal axis 25 of the inner chamber 16. A washer 28 is sandwiched between the angled surface 26 and an outer race 29 of a tapered roller bearing 30 located in the bearing cavity 27. An annular socket 32 engages the inner race 31 of the tapered roller bearing 30.

The angle block 18 has an end surface 34 in a plane that is non-orthogonal with respect to the longitudinal axis 25 of the inner chamber 16. An annular retainer plate 36 is held against that end surface 34 by a tubular sleeve 38 which abuts the end cap 14. The retainer plate 36 and the sleeve 38 are prevented from rotating by a second locking pin 40 which extends through apertures in both of those elements and into an aperture in the angle block 18. The retainer plate 36 provides a substantially planar retainer surface 35 that is non-orthogonal to the longitudinal axis 25.

Figure 2:
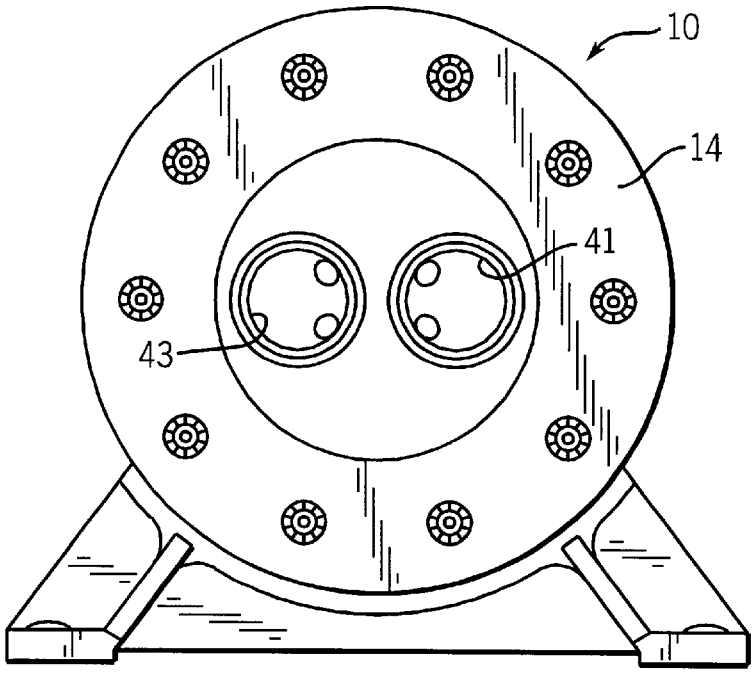
FIG. 2 is a plane view of an end of the hydraulic pump.
Figure 3:
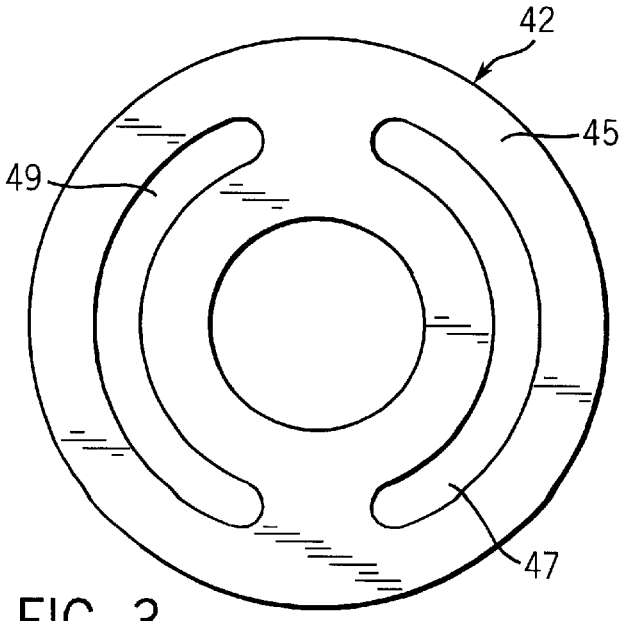
FIG. 3 is a plane view of a valve plate shown in FIG. 1.

The fluid inlet 41 and outlet 43 for the pump are formed in the end cap 14 as shown in FIG. 2 and communicate with a conventional floating valve plate 42 which abuts the end cap 14 within chamber 16. The valve plate 42 has conventional kidney shaped inlet and outlet slots 47 and 49, shown in FIG. 3, which open into the inner chamber 16 of the body 13. Referring again to FIG. 1, a cylinder block 44 abuts a flat surface 45 of the valve plate 42 having the inlet and outlet slots 47 and 49. The cylinder block 44 has a central aperture 57 with a roller bearing 58 located therein. An axial pin 60 fits within the roller bearing 58 extending outward from the cylinder block 44 through a central opening in the valve plate 42 and into a receiving aperture in the end cap 14. As will be described, the prime mover for the pump causes the cylinder block 44 to rotate on the axle pin 60.

The surface of the cylinder block 44, which abuts the valve plate 42, has openings 46 into a plurality of piston bores 48 located axially around the axle pin 60. A typical pump may have nine bores with only two bores being visible in the drawing. Within each bore 48 is a separate piston 50 that has an internal cavity 52 with an opening facing the cylinder block passage 46. Each piston has a head 54. The pistons extend through a central aperture in the retainer plate 36 and through individual apertures 53 in a hold down plate 56 which rests against the angled retainer surface 35 of the retainer plate. Each piston has a head 54 on the remote side of the hold down plate 56 and the end surface of the piston heads abut a drive surface 55 of the socket 32 that is angled with respect to the longitudinal axis 25 of the pump mechanism. As will be described, rotation of the pump components causes the pistons to ride against the angled drive surface 55 of the socket which pushes the pistons 50 into their respective bores 48 during half of the rotation cycle. During the other half cycle of rotation, the hold down plate 54 engages the piston heads and pulls the pistons 50 out of those bores.

The cylinder block 44 has an integral shaft 64 projecting from the side that is remote from the valve plate 42. That shaft 64 extends through the central openings in the retainer plate 36, the hold down plate 56 and the socket 32. A socket collar 66 is placed around the shaft abutting the main body of the cylinder block 44. The collar 66 engages a ball 68 that has an aperture through which the shaft extends. The spherically curved surface of the ball rests in a mating relationship within a spherically curved concave aperture 69 of the socket 32, thereby supporting the ball 68 and the shaft 64 of the cylinder block 44. By supporting the shaft of the cylinder block 44 with a spherical ball and socket arrangement, the first bearing 30 receives the shaft load and the side loads from the pistons. This arrangement also enables the number of bearings to be reduced from previous in-line axial piston pump designs. Although the ball 68 is shown as a separate component from the cylinder block, the ball could be formed integrally on the cylinder block shaft 64. Therefore, as used herein the cylinder block 44 is considered as including the ball 68 even though they may be separate components and even though the cylinder block shaft 64 may be able to rotate independently of the ball.

The shaft 64 of the cylinder block 44 has a central aperture 70 with inner splines. The aperture receives the end of a splined drive shaft 71 which extends from a motor or other type of prime mover for the pump 10. The splines of the drive shaft 32 and the shaft aperture 64 mesh so that the cylinder block 44 rotates with the drive shaft. A helical spring 72 is located within the aperture 70 of the cylinder block shaft 64 and biases the drive shaft 71 outwardly from that shaft.

Upon rotation by the prime mover, the drive shaft 71 transfers rotational force to the shaft 64 which causes the integral cylinder block 44 to rotate against the surface 45 of the valve plate 42. Rotation of the cylinder block 44 carries the pistons 50 in a circular motion. That motion is transferred to the socket 32 by friction between surfaces of the socket 32 and the piston heads 54 and ball 64. Because the socket engages the inner race of the tapered roller bearing 30 which provides a low friction rotational support, the socket 32 tends to rotate with the cylinder block 44. However, rotation of the socket 34 is about the axis of the inner race 31 of the tapered roller bearing 30 which axis intersects the longitudinal axis 25 of the cylinder block at an acute angle. Thus as the cylinder block rotates, the pistons 50 are reciprocally pushed into and pulled out of the respective bores 48 by the angular rotation of the socket 32. For example, as shown in the drawing the lower piston 50 has been pulled outward through its respective bore, whereas the upper illustrated piston 50 has been pushed almost fully into its bore 48 by the socket 32. This reciprocal movement of the pistons produces the pumping action.

As the inner components of the pump 10 rotate, the socket 32 wobbles about the ball 68. Specifically, the upper most portion of the socket 32, in the orientation of the device in FIG. 1, has been pushed rightward so as to nearly abut the socket collar 66, whereas the lower portion of the socket 32 has moved away from the socket collar 66. When the device rotates 180° from the position illustrated in FIG. 1, the portion of the socket 32 which had been uppermost has rotated into the lower position and wobbled on the ball 68 away from the socket collar 66. Similarly, in this 180° position, the portion of the socket 32 which was previously in the lowermost location now has rotated into the uppermost position where it nearly contacts the socket collar 66.

By utilizing the ball and socket arrangement of the present invention, only two bearings 30 and 58 are required. In addition, the overall axially length of the pump has been reduced. Thereby, conserving both weight and space.

What is claimed is:

1. A pump for hydraulic fluid, said pump comprising:

a housing having a fluid inlet and a fluid outlet with a longitudinal axis both of which opening into an inner chamber;

a cylinder block with a plurality of piston bores and supported within the inner chamber for rotation about a longitudinal axis, wherein during rotation each piston bore alternately communicates with the fluid inlet and a fluid outlet, the cylinder block including an element with a spherically curved surface and further including a coupling for a rotating drive member;

a socket having an aperture with a curved surface that mates with the spherically curved surface of the element of the cylinder block, the socket having a drive surface that is non-orthogonal to the longitudinal axis;

a plurality of pistons each slidably located within a different one of the plurality of piston bores and having a head which engages the drive surface of the socket; and a coupling bearing which extends between the housing and the socket to support the cylinder block axially for rotational movement within the inner chamber.

2. The pump as recited in claim 1 further comprising an angle block located within the inner chamber and forming a bearing cavity; and the coupling bearing within the bearing cavity and engaging angle block and the socket.

3. The pump as recited in claim 2 wherein the coupling bearing rotates about an axis that is non-coaxial with the longitudinal axis.

4. The pump as recited in claim 1 further comprising another bearing rotationally coupling the cylinder block to the housing.

5. The pump as recited in claim 1 further comprising a hold down plate having a plurality of apertures though which the plurality of pistons extend, wherein the hold down plate abuts a retainer surface of the housing which is non-orthogonal to the longitudinal axis.

6. The hydraulic machine as recited in claim 5 wherein the retainer surface is substantially parallel to the drive surface of the socket.

7. A pump for hydraulic fluid, said pump comprising:

a housing having an inner chamber formed by an inner wall;

an angle block within the inner chamber proximate to the inner wall and having a bearing cavity;

a first bearing within the bearing cavity and having a first race engaging the angle block, the first bearing comprising a second race that rotates about an axis that is non-coaxial with the longitudinal axis;

an annular socket engages the second race of the first bearing, the annular socket having an aperture formed by a curved concave surface and having a drive surface;

a cylinder block with a plurality of piston bores and supported within the inner chamber of the housing for rotation about a longitudinal axis, the cylinder block including a partially spherical member within the aperture of the annular socket and including a coupling for a drive shaft that produces rotation of the cylinder block; and a plurality of pistons each slidably located within one of the plurality of piston bores and having a head which engages the drive surface of the annular socket.

8. The pump as recited in claim 7 wherein the drive surface of the annular socket is substantially planar.

9. The pump as recited in claim 7 wherein the first bearing is a tapered roller bearing.

10. The pump as recited in claim 7 further comprising a second bearing coupling the cylinder block to the housing.

11. The pump as recited in claim 7 further comprising a second bearing coupling that engages the cylinder block; and an axial pin that engages the second bearing and the housing.

12. The pump as recited in claim 7 further comprising a hold down plate having a plurality of apertures through which the plurality of pistons extend, wherein the hold down plate abuts a substantially planar retainer surface of the housing which retainer surface is non-orthogonal with respect to the longitudinal axis.

13. A pump for hydraulic fluid, said pump comprising:

a housing having an inner chamber formed by an inner wall with an opening for a drive shaft, the inner chamber having a longitudinal axis;

an angle block within the inner chamber proximate to the inner wall and having a bearing cavity;

a first bearing within the bearing cavity and having a first race and a second race, wherein the first race engages the angle block;

an annular socket engages the second race of the first bearing, the annular socket having an aperture formed by spherically concave surface and the annular socket having a substantially planar surface that is non-orthogonal to the longitudinal axis;

a cylinder block with a plurality of piston bores and rotationally supported within the inner chamber of the housing, the cylinder block including a spherically curved member within the aperture of the annular socket and including a coupling for the drive shaft that produces rotation of the cylinder block about the longitudinal axis; and a plurality of pistons each slidably located within one of the plurality of piston bores and having a head which engages the substantially planar surface of the annular socket.

14. The pump as recited in claim 13 wherein the first bearing rotates about an axis that is non-coaxial with the longitudinal axis.

15. The pump as recited in claim 13 wherein the first bearing is a tapered roller bearing.

16. The pump as recited in claim 13 further comprising a second bearing coupling the cylinder block to the housing.

17. The pump as recited in claim 13 further comprising a second bearing coupling that engages the cylinder block; and an axial pin that engages the second bearing and the housing.

18. The pump as recited in claim 13 further comprising a hold down plate having a plurality of apertures through which the plurality of pistons extend, wherein the hold down plate abuts a substantially planar retainer surface of the housing which is non-orthogonal with respect to the longitudinal axis.

* * * * *

UNITED STATES PATENT AND TRADEMARK OFFICE

CERTIFICATE OF CORRECTION

PATENT NO. : 6,287,086 B1
DATED : September 11, 2001
INVENTOR(S) : Kevin W. Steen It is certified that error appears in the above-identified patent and that said Letters Patent is hereby corrected as shown below:

Column 4,
Line 42, replace claim 6 with the following:
-- 6. The pump as recited in claim 5 wherein the retainer surface is substantially parallel to the drive surface of the socket. --

Signed and Sealed this

Twenty-fifth Day of June, 2002

*Attest:*

*Attesting Officer*

JAMES E. ROGAN
*Director of the United States Patent and Trademark Office*